US007694972B2

(12) United States Patent
Wertzberger

(10) Patent No.: US 7,694,972 B2
(45) Date of Patent: Apr. 13, 2010

(54) DOUBLE BUTTON POKER

(75) Inventor: Stuart Wertzberger, San Diego, CA (US)

(73) Assignee: Maestro Associates, LLC, Willmington, DE (US)

( * ) Notice: Subject to any disclaimer, the term of this patent is extended or adjusted under 35 U.S.C. 154(b) by 35 days.

(21) Appl. No.: 11/973,261

(22) Filed: Oct. 5, 2007

(65) Prior Publication Data

US 2009/0091083 A1 Apr. 9, 2009

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS 6,234,483 B1 * 5/2001 Bucan ..... 273/292
2007/0063439 A1 * 3/2007 Webb ..... 273/292

* cited by examiner

*Primary Examiner*—Gene Kim
*Assistant Examiner*—Amir Klayman
(74) *Attorney, Agent, or Firm*—Wolff & Samson PC

(57) ABSTRACT

A poker game utilizing two buttons which include a Dealer Button that is utilized as in conventional Texas Hold'Em rules, and a winner's button which is given to the winner of a hand and permits the winner to bet last in all rounds of betting in a subsequent hand until a new winner is determined.

19 Claims, No Drawings

DOUBLE BUTTON POKER

BACKGROUND OF THE INVENTION

The present invention relates to card games, and more particularly to poker, and specifically to the poker games of Texas Hold'Em, Omaha and Omaha 8 or Better. Currently, Texas Hold'Em is one of the most popular poker games being played at gaming establishments in both the real and virtual worlds.

SUMMARY OF THE INVENTION

It is an object of the present invention to provide a revised version of Texas Hold'Em, Omaha and Omaha 8 or Better which provides modified betting opportunities when compared with conventional rules for these games.

Pursuant to this object and other which will be become apparent hereafter, one aspect of the present invention resides in a poker game in which an additional, "Winner's Button" is utilized, the holder of which is in the desirable position of being last to place bets during the hand.

Although the game will be described as being played live at a gaming table, it is within the ambit of the present invention that the play of the game can be implemented electronically, such as on an electronic gaming machine, a portable hand held device, a stand-alone game machine, a personal computer, and others that are commercially available and known to those skilled in the art.

Other features and advantages of the present invention will become apparent from the following description of the invention.

DETAILED DESCRIPTION OF THE INVENTION

The invention will be described in connection with each of the card games Texas Hold'Em, Omaha and Omaha 8 or Better.

As is known, the basic rules for Texas Hold'Em are as follows. The dealer shuffles a standard 52-card deck. In casinos, the dealer never plays. A round disk known as a "Dealer Button" moves clockwise from player to player with each hand. The button marks which player would be the dealer if the deal were advanced from player to player as the game went along. Generally, the game starts with one or two players to the left of the dealer (the Dealer Button) putting a predetermined amount of money into the pot before any cards are dealt. This amount is referred to as "The Blind", with the first player's amount being the "Small Blind" and the second player's amount being the "Big Blind".

Next, each player is dealt two cards face down. At this point, betting begins with the player to the left of the two players who posted The Blinds.

After the first round of betting, the dealer deals three cards face up on the table, these cards are called "The Flop". If desired, before dealing The Flop, the dealer can discard or "burn" the top card on the deck.

After The Flop, another round of betting takes place similarly to the first round. After the second round of betting, a fourth card is dealt by the dealer face up on the table. This fourth card is called "The Turn". Again, the dealer can burn or discard the top card in the deck before dealing The Turn. A third round of betting then takes place after The Turn as in the first two rounds. After the third round of betting, the dealer deals a fifth and final card face up on the table, which card is known as "The River". As previously mentioned, the dealer can burn or discard the top card on the deck before dealing The River card.

Next, a final round of betting takes place. After this final round of betting, each player can use any combination of seven cards consisting of the two cards in a player's hand and the five community cards face up on the table to form the best possible 5-card poker hand. The player with the best hand wins.

To this point, the present invention follows the same rules as conventional Texas Hold'Em. From this point on, however, the betting hierarchy changes from hand to hand. The winner of this first hand receives a "Winner's Button". In the subsequent hand the player holding the Winner's Button is skipped over in the betting no matter what position he/she is in until all others have acted including the player with the Dealer Button and the Small and Big Blinds. After the Big Blind has acted, betting moves to the holder of the Winner's Button who is in the position to bet last. Play and betting continue throughout the course of the hand with all of the positions continuing to act in the order prescribed by the traditional rules, with the exception of the holder of the Winner's Button who would continue to bet last after all of the other players have bet.

After this subsequent hand is over and the winner determined, the Winner's Button is passed to that winner. The game then continues from hand to hand with the Winner's Button being passed from winner to winner while the Dealer's Button continues its clockwise rotation around the table.

In the event of a split pot, the Winner's Button goes to the same person who would normally receive the extra chip according to local casino/poker room rules.

This modified version of Texas Hold'Em is attractive to gamblers in that being in the final betting position is desirable from a strategy perspective. Therefore, the present invention is attractive in that it presents to the players the opportunity to be in an advantageous betting position if they are winning.

Therefore, when playing the double button poker game of the present invention, the first hand of a game, or a hand where the winner of the previous hand leaves the table, would only use a single Dealer Button. Every other hand will utilize both the Dealer's Button and a second, Winner's Button.

Omaha is played similar to Texas Hold'Em with the following differences:

1. each player is dealt four cards instead of two (however there are still five community cards); and
2. to form the best hand, each player must use two cards from his hand and any combination of three cards from the five community cards.

The use of the Winner's Button and Dealer's Button as described previously in connection with double button Texas Hold'Em is the same.

Omaha 8 or Better is similar to Omaha, except if there are three cards on the board that allow a low hand to be made that include an eight and two lower cards, the pot will be split between the winning high hand and the winning low hand. If there are not three cards of eight or below among the five community cards, then the hand is played the same as Omaha.

For a split pot in Omaha 8 or Better, the Winner's Button goes to the high hand winner.

Although the present invention has been described in relation to particular embodiments thereof, many other variations and modifications and other uses will become apparent to those skilled in the art. It is preferred, therefore, that the present invention be limited but by the specific disclosure herein, but only by the appended claims.

The invention claimed is:

1. A method of playing a poker game, comprising the steps of:

a.) assigning a dealer button to a player;

b.) requiring at least one player to the left of the player with the dealer button to place a blind bet;

c.) dealing at least two cards from a physical deck of cards face down to each player;

d.) conducting a first round of betting beginning with the player to the left of the player placing the blind bet;

e.) dealing three community cards face up;

f.) conducting a second round of betting;

g.) dealing a fourth community card face up;

h.) conducting a third round of betting;

i.) dealing a fifth community card face up;

j.) conducting a final round of betting;

k.) determining a winning player based on a best five-card poker hand determined for each player from the cards in the player's hand and the five community cards;

l.) awarding a winner's button to the winning player; and m.) in a subsequent hand, permitting the player holding the winner's button to bet last in all rounds of betting;

wherein the player holding the winner's button is skipped over when it would normally otherwise be their turn to bet until all players have bet, and the betting returns to the player holding the winner's button for the final betting opportunity.

2. The method according to claim 1, wherein step b.) further includes two players to the left of the dealer button placing a blind bet.

3. The method according to claim 1, wherein the dealer button moves from player to player once each hand.

4. The method according to claim 1, including discarding a top card on the deck before dealing the cards in steps e.), g.) and i.).

5. The method according to claim 1, wherein step c.) includes dealing four cards facedown to each player and step k.) includes determining a winner by each player using a combination of two cards from his hand and three of the community cards.

6. The method according to claim 5, including splitting the pot between a winning high hand and a low hand if the community cards include an eight as well as two lower cards.

7. The method according to claim 3, wherein the dealer button moves clockwise from player to player.

8. The method according to claim 1, wherein if a winning player leaves the game a subsequent hand is played with only the dealer button to determine a winner who will receive the winner's button for subsequent hands.

9. The method according to claim 6, wherein when two winners are determined in step k.), the winner's button is awarded to the player holding the high hand.

10. The method according to claim 1, wherein when two winners are determined in step k.), the winner's button is awarded to the player that would receive an extra chip according to local house rules.

11. The method according to claim 1, wherein the second round of betting performed in step f.) begins with the player to the left of the player with the dealer button.

12. The method according to claim 1, wherein the third round of betting performed in step h.) begins with the player to the left of the player with the dealer button.

13. The method according to claim 1, wherein the final round of betting performed in step j.) begins with the player to the left of the player with the dealer button.

14. A method of playing a game, comprising:

a.) dealing at least one card from physical deck of cards to each player;

b.) conducting at least one round of betting;

c.) determining a winning player based on the player's cards and any community cards;

d.) in a subsequent hand, skipping the winning player in at least one round of betting when the winning player does not have a dealer button and allowing the winning player to bet last.

15. The method of claim 14, wherein the winning player bets last in all betting rounds in a subsequent hand.

16. The method of claim 14, further comprising:

assigning a dealer button to a player;

requiring at least one player to the left of the player with the dealer button to place a blind bet;

dealing at least two cards face down to each player;

conducting a first round of betting beginning with the player to the left of the player placing the blind bet;

dealing three community cards face up;

conducting a second round of betting;

dealing a fourth community card face up;

conducting a third round of betting;

dealing a fifth community card face up; and conducting a final round of betting;

wherein the winner player is determined based on a best five-card poker hand determined for each player from the cards in the player's hand and the five community cards.

17. A method of playing a card game performing the following steps using a computer comprising:

a.) dealing at least one card to each player;

b.) conducting at least one round of betting;

c.) determining by the computer a winning player based on the player's cards and any community cards;

d.) in a subsequent hand, skipping the winning player in at least one round of betting when the winning player does not have a dealer button and allowing the winning player to bet last.

18. The method according to claim 17, wherein the winning player bets last in all betting rounds in a subsequent hand.

19. The method according to claim 17, the method further comprising:

assigning a dealer button to a player;

requiring at least one player to the left of the player with the dealer button to place a blind bet;

dealing at least two cards face down to each player;

conducting a first round of betting beginning with the player to the left of the player placing the blind bet;

dealing three community cards face up;

conducting a second round of betting;

dealing a fourth community card face up;

conducting a third round of betting;

dealing a fifth community card face up; and conducting a final round of betting;

wherein the winner player is determined based on a best five-card poker hand determined for each player from the cards in the player's hand and the five community cards.

* * * * *